US009907387B2

(12) United States Patent
Kim

(10) Patent No.: US 9,907,387 B2
(45) Date of Patent: Mar. 6, 2018

(54) STRAW-TYPE ADJUSTABLE COSMETIC APPLICATOR

(71) Applicant: AA R&D LLC, Leonia, NJ (US)

(72) Inventor: Yoon-Hoi Kim, Leonia, NJ (US)

(73) Assignee: AA R&D LLC, Leonia, NJ (US)

( * ) Notice: Subject to any disclaimer, the term of this patent is extended or adjusted under 35 U.S.C. 154(b) by 0 days.

(21) Appl. No.: 14/980,214

(22) Filed: Dec. 28, 2015

(65) Prior Publication Data

US 2016/0198834 A1 Jul. 14, 2016

Related U.S. Application Data

(60) Provisional application No. 62/102,738, filed on Jan. 13, 2015.

(51) Int. Cl.

| | |
|---|---|
| ***A45D 40/26*** | (2006.01) |
| ***A46B 5/00*** | (2006.01) |
| ***A46B 9/02*** | (2006.01) |

(52) U.S. Cl.

CPC ..... *A45D 40/265* (2013.01); *A45D 40/267* (2013.01); *A46B 5/0066* (2013.01); *A46B 9/021* (2013.01); *A46B 2200/1053* (2013.01)

(58) Field of Classification Search

CPC ..... A45D 40/265
USPC ..... 401/118, 123, 126, 127, 128, 129, 130
See application file for complete search history.

(56) References Cited

U.S. PATENT DOCUMENTS

| | | | | |
|---|---|---|---|---|
| 4,428,388 A * | 1/1984 | Cassai | ..... | A46B 9/021 132/218 |
| D300,956 S † | 5/1989 | Cassai | | |
| 7,344,327 B2 * | 3/2008 | Gueret | ..... | A45D 34/045 401/126 |
| 2002/0066151 A1 † | 6/2002 | Parker | | |

FOREIGN PATENT DOCUMENTS

JP 2004-229710 † 8/2004

OTHER PUBLICATIONS

Notice of Reasons for Rejection dated Jun. 20, 2017, issued in counterpart Korean Application No. 10-2016-0001037, with English translation. (11 pages).
Office Action dated Nov. 17, 2017, issued in counterpart Korean Application No. 10-2016-0001037, with English translation (6 pages).

* cited by examiner
† cited by third party

*Primary Examiner* — David Walczak
*Assistant Examiner* — Joshua Wiljanen
(74) *Attorney, Agent, or Firm* — Westerman, Hattori, Daniels & Adrian, LLP

(57) ABSTRACT

An adjustable cosmetic applicator including a handle unit with a rod unit coupled thereto and defining a rod with a rod central axis. An applying unit includes a brush rod with a brush central axis and a brush extending from the brush rod. A flexible portion interconnects the rod and the brush rod such that the applying unit may be rotated relative to the rod unit with the brush central axis angled relative to the rod central axis.

6 Claims, 6 Drawing Sheets

STRAW-TYPE ADJUSTABLE COSMETIC APPLICATOR

FIELD OF THE INVENTION

The present invention relates to a cosmetic applicator, and more particularly, to an adjustable cosmetic applicator that allows an applying unit through which a cosmetic liquid is applied to be adjusted in angle thereof by means of a user's manipulation.

BACKGROUND OF THE INVENTION

Mascara applicators are used to apply various colors of mascara liquids to eyelashes to enhance the eyes. The mascara applicator largely includes a handle and a brush, onto which a mascara liquid is applied.

So as to apply the mascara liquid to a user's eyelashes, first, the brush is inserted into a mascara case into which the mascara liquid is contained and is coated with the mascara liquid, and next, the brush is rotated on the eyelashes to raise the eyelashes upwardly, so that the mascara liquid is applied fully to the eyelashes to make them curvedly erected.

However, the above-mentioned conventional mascara has the handle and the brush arranged in a straight line, which gives many inconveniences in use.

For example, the make-up is conducted in the state where the eyelashes and the brush are arranged in a parallel with each other, and at this time, a user arm should be raised to her shoulder's height to make the brush located in parallel with her eyelashes, which causes her make-up operation to be performed in an unstable posture, thereby resulting in bad make-up.

SUMMARY OF THE INVENTION

Accordingly, the present invention has been made in view of the above-mentioned problems occurring in the prior art, and it is an object of the present invention to provide an adjustable cosmetic applicator that allows an applying unit through which a cosmetic liquid is applied to be adjusted in angle thereof by means of a user's manipulation caused by her applying habit or preference.

To accomplish the above object, according to the present invention, there is provided an adjustable cosmetic applicator including: a handle unit adapted as a cap coupled to a cosmetic container body; a rod unit moved linearly by means of the manipulation of the handle unit; and an applying unit operated cooperatively with the linear motion of the rod unit in such a manner as to be adjusted in angle.

According to at least one embodiment, the invention provides an adjustable cosmetic applicator including a handle unit with a rod unit coupled thereto and defining a rod with a rod central axis. An applying unit includes a brush rod with a brush central axis and a brush extending from the brush rod. A flexible portion interconnects the rod and the brush rod such that the applying unit may be rotated relative to the rod unit with the brush central axis angled relative to the rod central axis. In at least one embodiment, the flexible portion includes a tubular structure of deformable material. In at least one embodiment, the flexible portion has an accordion structure with a plurality of spaced apart pleats.

According to at least one embodiment, the invention provides a cosmetic assembly an adjustable cosmetic applicator and a cosmetic container. The cosmetic container has a throat portion configured to maintain the applying unit as the handle unit is rotated relative thereto.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
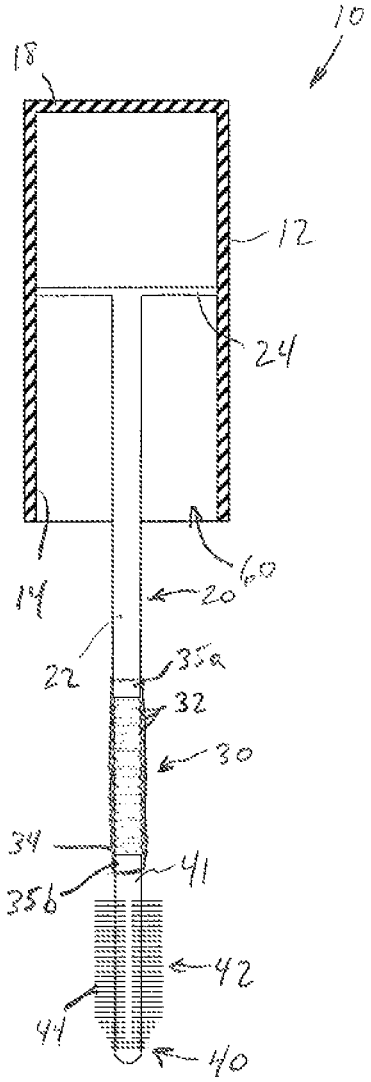
FIG. 1 is cross-sectional view of a cosmetic applicator in accordance with an embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring to FIG. 1, an adjustable cosmetic applicator 10 according to an exemplary embodiment of the invention generally includes a handle unit 12, a rod unit 20, an applying unit 40 and a flexible portion 30 defined between the rod unit 20 and the applying unit 40. In the illustrated embodiment, the handle unit 12 is detachably mounted on a cosmetic container 60 (see FIG. 5) with the handle unit 12 made in a form of a cap. For example, a male screw portion 62 is formed on the inlet side of the cosmetic container 60, and a female screw portion 14 is formed on the inner periphery of the handle unit 12 in such a manner as to be screw-coupled to the male screw portion 62 of the cosmetic container 60, thereby conducting the detachable coupling therebetween.

Figure 5:
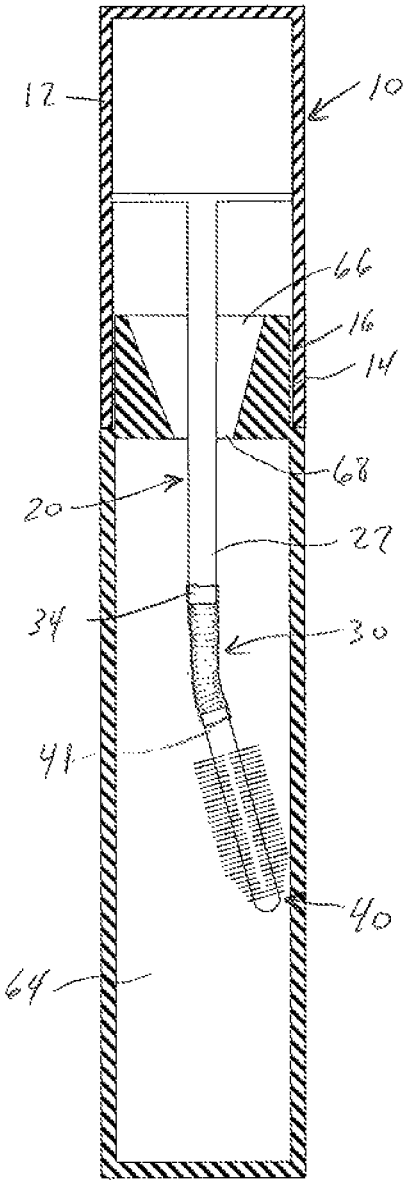
FIG. 5 is a cross-sectional view ill strafing the cosmetic applicator of FIG. 1 returned to the cosmetic container.

The rod unit 20 extends from an open end 16 of the handle unit 12. In the illustrated embodiment, the rod unit 20 includes a rod 22 extending from a platform 24 positioned within the handle unit 12. Alternatively, the rod 22 may be connected directly with the handle unit 12, for example, extending from the closed end 18 thereof. The rod 22 is configured to extend inside the cosmetic container 60 when the handle unit 12 is coupled to the cosmetic container 60 as illustrated in FIG. 5.

Figure 4:
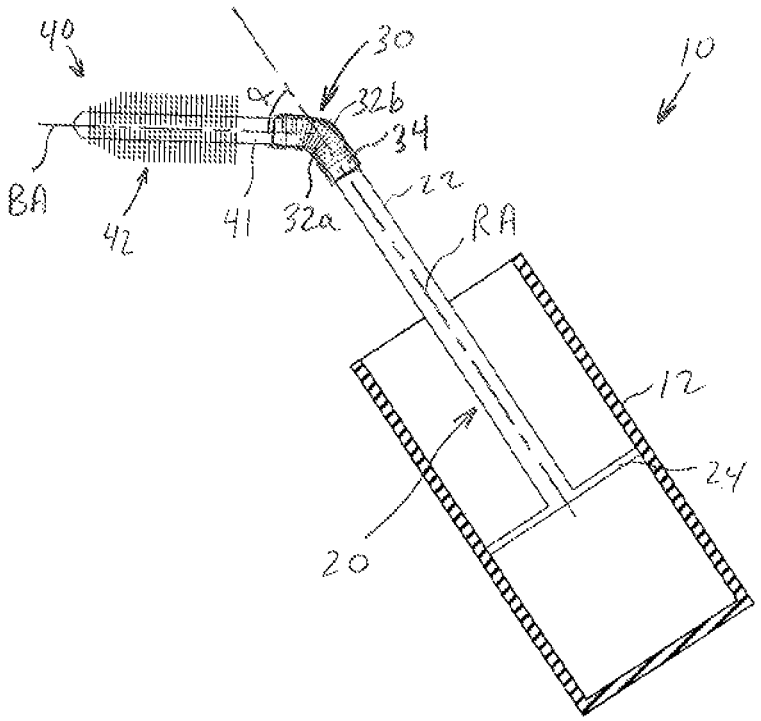
FIG. 4 is a cross-sectional view illustrating the cosmetic applicator of FIG. 1 in an angled use position.

The applying unit 40 includes a brush rod 41 having a brush 42 disposed at one end thereof to apply the cosmetic liquid therethrough. The brush 42 may be formed of bristles 11, sponges, or the like. The brush rod 41 of the applying unit 40 is coupled to the end of the rod 22 of the rod unit by means of the flexible portion 30 the present embodiment, the flexible portion 30 has an accordion structure which includes a plurality of spaced apart pleats 32. The pleats 32 allow the flexible portion 30 to expand and compress such that the brush rod 41 of the applying unit 40 may be angled relative to the rod 22 of the rod unit 20. More specifically, as illustrated in FIG. 4, the pleat portions 32*a* along the inside of the curvature compress while the pleat portions 32*b* along the outside of the curvature expand. With this configuration, the central axis BA of the brush rod 41 may be angled relative to the central axis RA of the rod 22 by an angle α. The angle α is preferably between about 0° to 120° and more preferably between about 0° to 90°.

Referring again to FIG. 1, a flexible tubular sleeve 34 (shown transparent) may extend over the flexible portion 30 with one end 35*a* sealed about the rod 22 and the other end 35*b* sealed about the brush rod 41. The flexible sleeve 34 prevents formula from getting in between the pleats 32 thereby reducing the possibility of formula impeding the flexible portion 30 or of dried formula dust from occurring. The rod 22, flexible portion 30, sleeve 34 and the brush rod 41 are preferably formed as a unitary structure, but may be formed as separate components and connected to one another. In one embodiment, the rod 22, flexible portion 30, sleeve 34 and the brush rod 41 are hollow structures. Preferably the components are made out of plastic, such as thermo-set or thermo-resin plastic. Examples may include polypropylene or polystyrene. The components may be blow molded, extrusion molded or otherwise manufactured.

Figure 6:
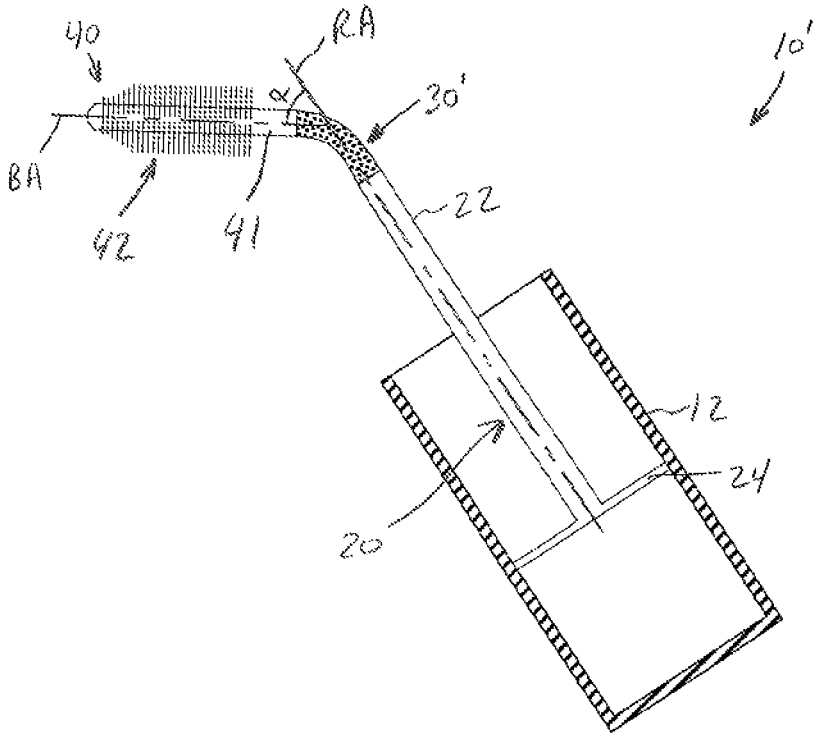
FIG. 6 is a cross-sectional view illustrating another exemplary embodiment of a cosmetic applicator in an angled use position.

FIG. 6 illustrates an adjustable applicator 10' according to another exemplary embodiment. The adjustable applicator 10' is substantially the same as in the previous embodiment, except that the flexible portion 30' has a non-pleated tubular structure which is manufactured from a deformable material. By deformable material, it is meant that the flexible portion 30 may be bent to form the angle α between the blush rod axis BA and the rod axis RA and will substantially maintain such angle until a sufficient force is applied to straighten the flexible portion 30'. The rod 22 and the brush rod 41 will have a substantially rigid configuration compared to the flexible portion. The rod 22, flexible portion 30' and the brush rod 41 are preferably formed as a unitary structure, but may be formed as separate components and connected to one another. The components may be blow molded, extrusion molded or otherwise manufactured.

Figure 2:
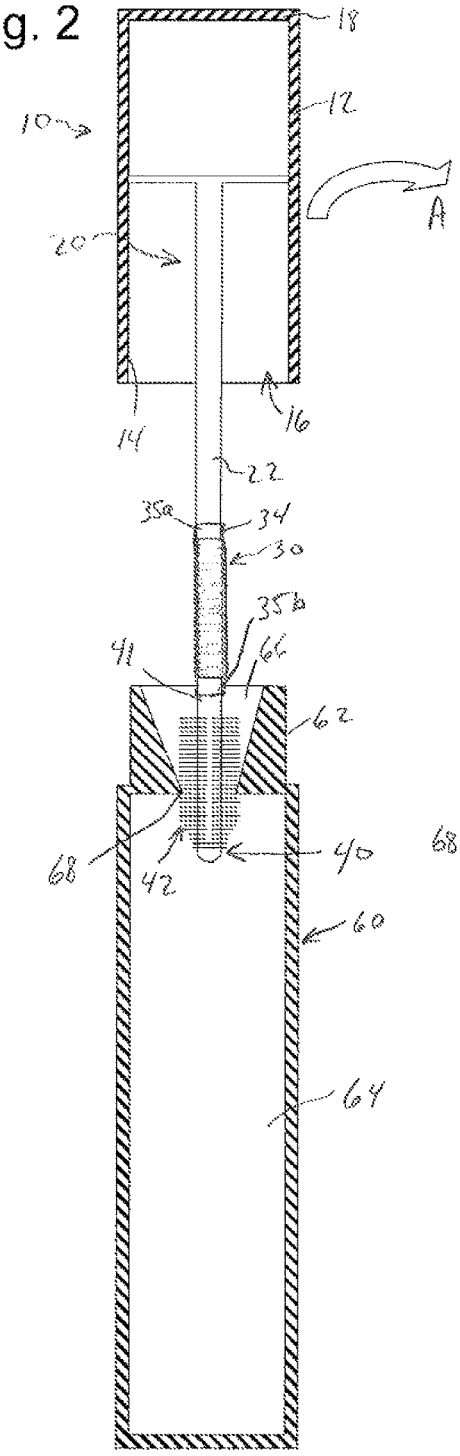
FIGS. 2 and 3 are sequential cross-sectional views illustrating removal and angling of the cosmetic applicator FIG. 1 relative to a cosmetic container.
Figure 3:
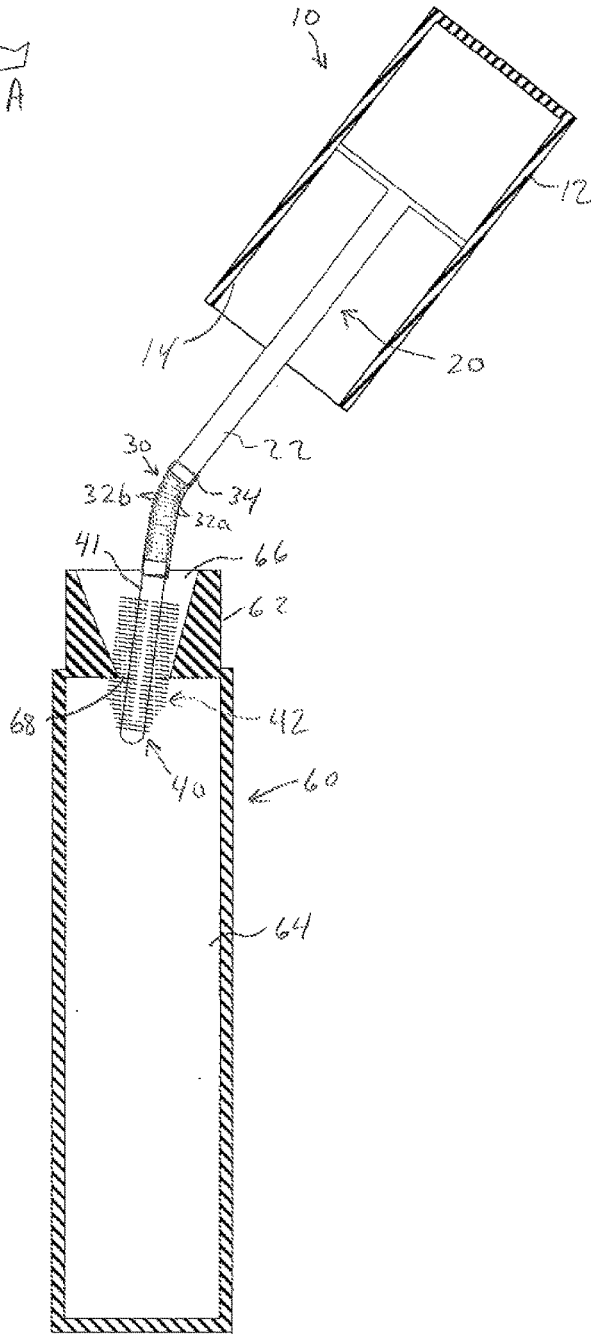

Having described the general components of the cosmetic applicator 10, use thereof will be described with reference to FIGS. 2-5. Use of the cosmetic applicator 10' will be the same and will not be separately explained. To apply the mascara liquid within the chamber 64 of the cosmetic container 60, the handle unit 12 is unscrewed and the applicator 10 is partially removed from the cosmetic container 60 as illustrated in FIG. 2. With the brush 42 of the applying unit 40 still within a narrow throat 68 of the cosmetic container 60, the handle unit 12 may be rotated as indicated by arrow A. The throat 68 maintains the orientation of the brush rod 41 and the rotating force causes the rod 22 to be angled relative to the brush rod 41 via the flexible portion 30, as indicated in FIG. 3. Once the desired angle α has been achieved, the applying portion 40 may be removed from the container 60 and the applicator 10 is ready for use, as illustrated in FIG. 4. While it is described herein to utilize the container 60 to angle the rod 22 relative to the brush rod 41, it is recognized that the angling may otherwise be achieved. For example, the user may remove the applicator 10 in a straight configuration and then achieve the desired angle α by applying the brushing unit 40 against a counter surface (not shown) or the like.

After the cosmetic has been applied, the applicator 10 is returned to the cosmetic container 60 as illustrated in FIG. 5. The applying unit 40 is passed into the open end 66 and through the throat 68. If necessary, the applying unit 12 may be rotated back relative to the applying unit 40 such that a portion of the rod 22, the flexible portion 30 and the applying unit 40 may be received in the chamber 64 of the cosmetic container 60. As illustrated, the applying unit 40 does not have to be returned to a position co-axial with the rod 22 and instead the flexible portion 30 may be left in an angled or partially angled position.

Figure 7:
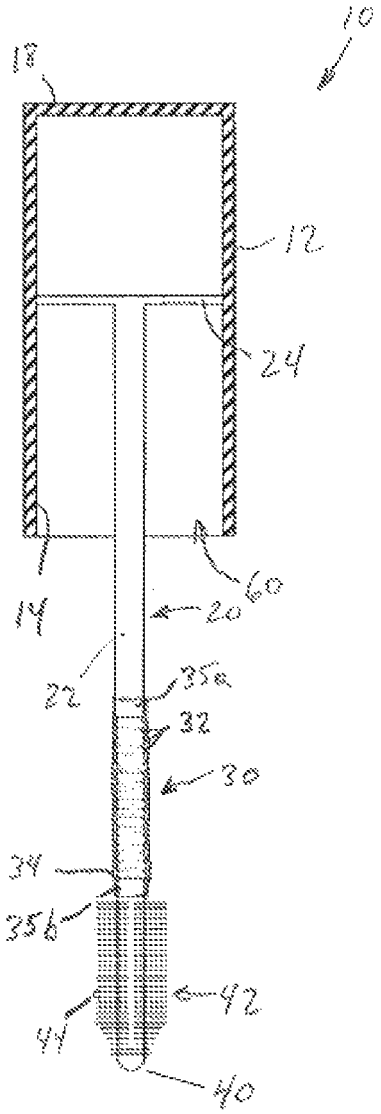
FIG. 7 is a cross-sectional view of the cosmetic applicator without a brush rod.

As illustrated in FIG. 7, the applying unit 40 may not include the brush rod 41 and includes the brush 42 only. Therefore, the applying unit 40 may be coupled directly with the flexible portion 30.

As described above, the adjustable cosmetic applicator according to the present invention allows the angle of the applying unit to be adjusted arbitrarily by means of the user, thereby permitting the cosmetic liquid to be applied in more natural and comfortable manners and further achieving the make-up according to the user's applying habit or preference.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. An adjustable cosmetic applicator comprising:

a handle unit;

a rod unit coupled to the handle unit and defining a rod with a rod central axis;

an applying unit including a brush rod with a brush central axis, the applying unit having a brush extending from the brush rod;

a flexible portion interconnecting the rod and the brush rod such that the applying unit may be rotated relative to the rod unit with the brush central axis angled relative to the rod central axis; and a flexible tubular sleeve extending over the flexible portion with one end sealed about the rod and the other end sealed about the brush rod, wherein the flexible portion maintains the angle until a sufficient force is applied to straighten the flexible portion.

2. The adjustable cosmetic applicator according to claim 1, wherein the flexible portion includes a tubular structure of deformable material.

3. The adjustable cosmetic applicator according to claim 1, wherein the flexible portion has an accordion structure with a plurality of spaced apart pleats.

4. The adjustable cosmetic applicator according to claim 1, wherein the brush central axis may be angled relative to the rod central axis between about 0° to 120°.

5. The adjustable cosmetic applicator according to claim 1, wherein the brush central axis may be angled relative to the rod central axis between about 0° to 90°.

6. A cosmetic assembly comprising:

an adjustable cosmetic applicator according to claim 1; and a cosmetic container, the cosmetic container having a throat portion configured to maintain the applying unit as the handle unit is rotated relative thereto.

* * * * *